US010113565B2

(12) United States Patent
Kopp

(10) Patent No.: US 10,113,565 B2
(45) Date of Patent: Oct. 30, 2018

(54) ENGINE NOZZLE SYNCHRONIZATION SYSTEM

(71) Applicant: Moog Inc., East Aurora, NY (US)

(72) Inventor: John Kopp, West Seneca, NY (US)

(73) Assignee: Moog Inc., East Aurora, NY (US)

( * ) Notice: Subject to any disclaimer, the term of this patent is extended or adjusted under 35 U.S.C. 154(b) by 177 days.

(21) Appl. No.: 15/312,123

(22) PCT Filed: Jun. 2, 2015

(86) PCT No.: PCT/US2015/033724
§ 371 (c)(1),
(2) Date: Nov. 17, 2016

(87) PCT Pub. No.: WO2015/187655
PCT Pub. Date: Dec. 10, 2015

(65) Prior Publication Data

US 2017/0089364 A1 Mar. 30, 2017

Related U.S. Application Data

(60) Provisional application No. 62/007,402, filed on Jun. 3, 2014.

(51) Int. Cl.
*F15B 9/10* (2006.01)
*F15B 11/22* (2006.01)
(Continued)

(52) U.S. Cl.
CPC ..... *F15B 11/22* (2013.01); *F15B 9/10* (2013.01); *F15B 9/16* (2013.01); *F15B 13/16* (2013.01)

(58) Field of Classification Search
CPC .... F15B 9/10; F15B 9/16; F15B 11/22; F15B 13/16
See application file for complete search history.

(56) References Cited

U.S. PATENT DOCUMENTS 2,346,418 A 4/1944 Dodson
2,657,539 A 11/1953 Geyer
(Continued)

FOREIGN PATENT DOCUMENTS

EP 0 831 027 A2 3/1998

OTHER PUBLICATIONS

International Preliminary Report on Patentability and Written Opinion of the International Searching Authority (8 pages) dated Dec. 15, 2016.

(Continued)

*Primary Examiner* — Michael Leslie
(74) *Attorney, Agent, or Firm* — Harter Secrest & Emery LLP

(57) ABSTRACT

An actuator synchronization system comprising a control valve in fluid communication with a plurality of actuators; each of the actuators comprising an input member moveable by the control valve, a main valve moveable from a null to an off-null position, an output member moveable from a first to a second output position, and a feedback linkage and a drive link configured such that selective movement of the input member causes movement of the valve from the null to the off-null position and movement of the output member to the second output position causes movement of the valve member from the off-null to the null position; and a mechanical connector between each of the input members or drive links of the actuators configured such that rotational motion of each of the respective drive links is synchronized.

20 Claims, 7 Drawing Sheets

(51) Int. Cl.
*F15B 9/16* (2006.01)
*F15B 13/16* (2006.01)

(56) References Cited

U.S. PATENT DOCUMENTS 3,398,646 A * 8/1968 Baltus ..... F15B 9/10
91/387
3,956,971 A * 5/1976 Meulendyk ..... F15B 13/16
91/384
3,977,300 A 8/1976 Sherman
4,598,626 A * 7/1986 Walters ..... F15B 13/16
91/459

OTHER PUBLICATIONS

International Search Report and Written Opinion of the International Searching Authority (9 pages) dated Aug. 31, 2015.

* cited by examiner

ENGINE NOZZLE SYNCHRONIZATION SYSTEM

TECHNICAL FIELD

The present invention relates generally to the field of engine nozzles, and more particularly to a nozzle synchronization system.

BACKGROUND ART

FIGS. 1-4 show a conventional nozzle synchronization system. As shown in FIG. 1, such prior art systems comprise a plurality of spaced apart actuators that are flow summed to a single two stage electrohydraulic servo valve. As a result, each actuator has its own friction, flow force, rate and force characteristics. As shown in FIGS. 1-4, the output of each actuator is linked via piston motion to an acme screw and worm gear and a flexible synchronization cable. Nozzle position is fed back to the system to control the electrohydraulic servo valve command.

BRIEF SUMMARY OF THE INVENTION

With parenthetical reference to the corresponding parts, portions or surfaces of the disclosed embodiments, merely for purposes of illustration and not by way of limitation, an actuator synchronization system (15) is provided comprising a control valve (18) in fluid communication with a plurality of actuators (16*a*-16*d*), each of the actuators comprising an input stage element in fluid communication with the control valve and having an input member (21) movably mounted along an input axis (61), and configured to be moved from a first input position (FIG. 7) to a second input position (FIG. 9) along the input axis by the control valve, a main valve (20) having a valve member (29) movably mounted in a valve chamber (28) along a main valve axis (62), and configured to be moved from a null position (FIG. 7) to an off-null position (FIG. 10) along the main valve axis to selectively meter fluid flow from at least one port (P1) defined between the valve member and the valve chamber, an output stage element in fluid communication with the port of the main valve and having an output member (26) moveably mounted along an output axis (63), and configured to be moved from a first output position (FIG. 7) to a second output position (FIG. 13) along the output axis by a pressure differential applied on the output member by the main valve, the main valve and the output member configured such that the output member is at a pressure equilibrium and does not move when the valve member is in the null position, a feedback linkage (22) acting between the valve member and the output member, an eccentric drive link (40) acting between the input member and the feedback linkage and configured to rotate about a fixed drive axis (44), the drive link rotationally connected to the feedback linkage at a first pivot (47) that is off-set a distance (54) from the fixed drive axis and configured such that selective motion of the input member between the first input position and the second input position along the input axis causes the pivot of the feedback linkage to rotate about the drive axis, the feedback linkage and the drive link configured such that selective movement of the input member from the first position to the second position causes the drive link and the feedback linkage to move the valve member from the null position to the off-null position, the movement of the valve member from the null position to the off-null position causes the pressure differential on the output member and the output member to thereby move from the first output position to the second output position, and the movement of the output member to the second output position causes the feedback linkage to move the valve member from the off-null position back to the null position; and a mechanical connector (17) between each of the input stage elements and/or the drive links configured such that rotational motion of each of the respective drive links about the respective fixed drive axis is substantially the same and thereby synchronized.

The control valve may comprise a servo valve. The respective fixed drive axes of the actuators may be aligned and the mechanical connector may comprise a shaft extending between the respective input stage elements and/or the respective drive links. The respective fixed drive axes of the actuators may not be aligned and the mechanical connector may comprise a cable or universal joint extending between the respective input stage elements and/or the respective drive links.

The input member may comprise an input piston (21) moveably mounted in an input chamber (25) in fluid communication with the control valve. The input piston may comprise a portion having a slot (24) bounded by substantially-parallel walls and the drive link may comprise a rounded marginal end portion (41) engaging the slot walls. The output member may comprise an output piston (26) moveably mounted in an output chamber (35) in fluid communication with the port of the main valve. The feedback linkage may comprise a first link (45) engaging the valve member at a first connection and a second link (49) engaging the output piston at a second connection. The valve member may comprise a slot (30) bounded by substantially-parallel walls and the first link of the feedback linkage may comprise a rounded marginal end portion (42) contacting the slot walls to form the first connection. The output piston may comprise a contoured surface (27) and the second link of the feedback linkage may comprise a rolling marginal end portion (51) configured to contact the contoured surface of the output piston to form the second connection. The feedback linkage may comprise a third link (48) connected to the first link at a third connection (52) and connected to the second link at a fourth connection (53). The first link and the third link may be rotationally coupled at the third connection and the second link and the third link may be rotationally coupled at the fourth connection. The second link may be configured to rotate about a fixed feedback axis (50) and the fourth connection (53) may be off-set a distance from the fixed feedback axis such that selective motion of the output piston between the first output position and the second output position along the output axis causes the fourth connection of the feedback linkage to rotate about the feedback axis. The feedback linkage may be configured to move the valve member from the null position to the off-null position with selective rotation of the drive link about the drive axis. The feedback linkage may be configured to move the valve member from the off-null position back to the null position with selective rotation about the feedback axis.

The main valve may comprise a second port (P2); the output member may comprise an output piston (26) moveably mounted in an output chamber in fluid communication with the port of the main valve; the output chamber may comprise a first chamber (33) and a second chamber (34); the first port may be flow connected to the first chamber and the second port may be flow connected to the second chamber; and the output piston may be adapted to be moved from the first position to the second position along the output axis as a function of a hydraulic pressure differential between the first chamber and the second chamber.

Each of the respective actuators may further comprise a bias mechanism (60) configured to bias one or more of the valve member, the drive link and the feedback linkage. The second link may be configured to rotate about a fixed feedback axis (50) and the bias mechanism may comprise a first bias element (60*a*) configured to bias the valve member along the main valve axis, a second bias element (60*b*) configured to bias the output member about the feedback axis and a third bias element (60*c*) configured to bias the drive link about the drive axis. The first bias element may comprise a compression spring and the third bias element may comprise a torsional spring.

The valve member may comprise a valve spool.

DESCRIPTION OF THE PREFERRED EMBODIMENTS

Figure 1:
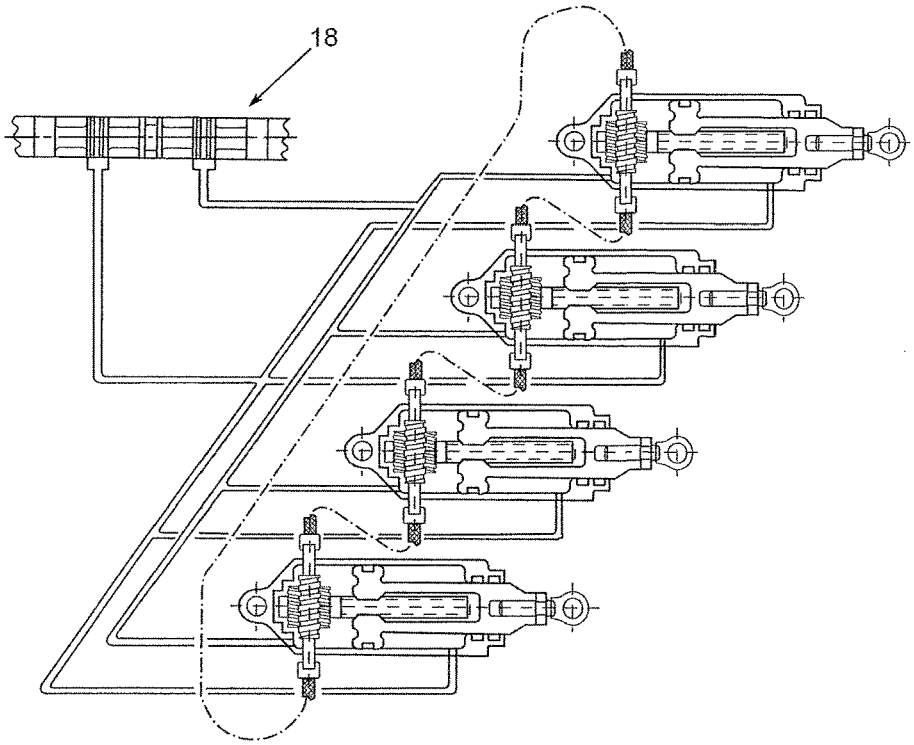
FIG. 1 PRIOR ART
FIG. 1 is a schematic view of a prior art nozzle synchronization system.
Figure 2:
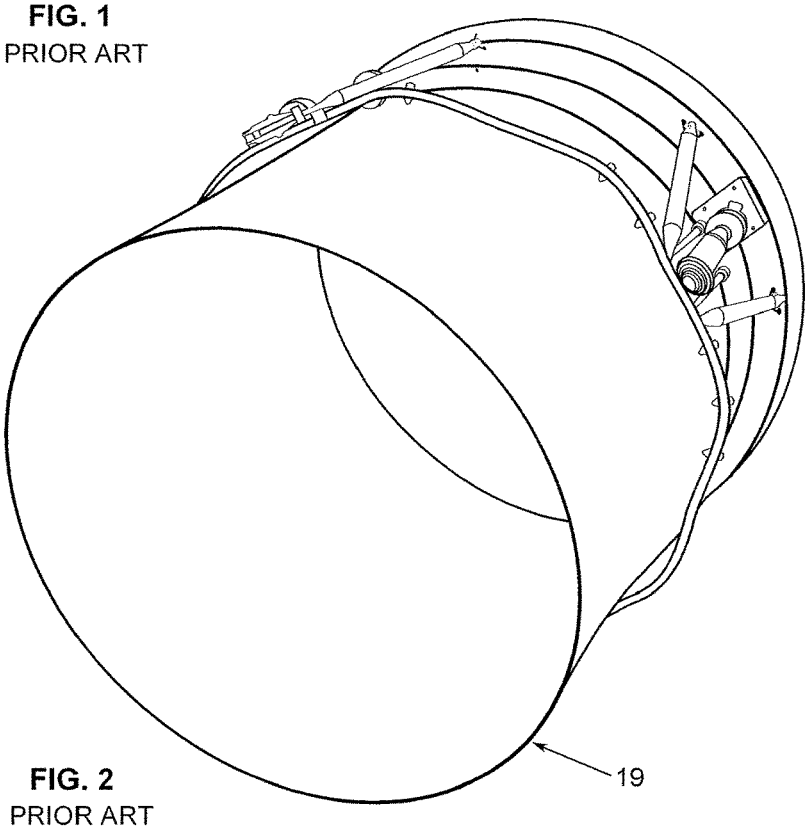
FIG. 2 PRIOR ART
FIG. 2 is a perspective view of the prior art nozzle synchronized system shown in FIG. 1 installed on a conventional nozzle.
Figure 3:
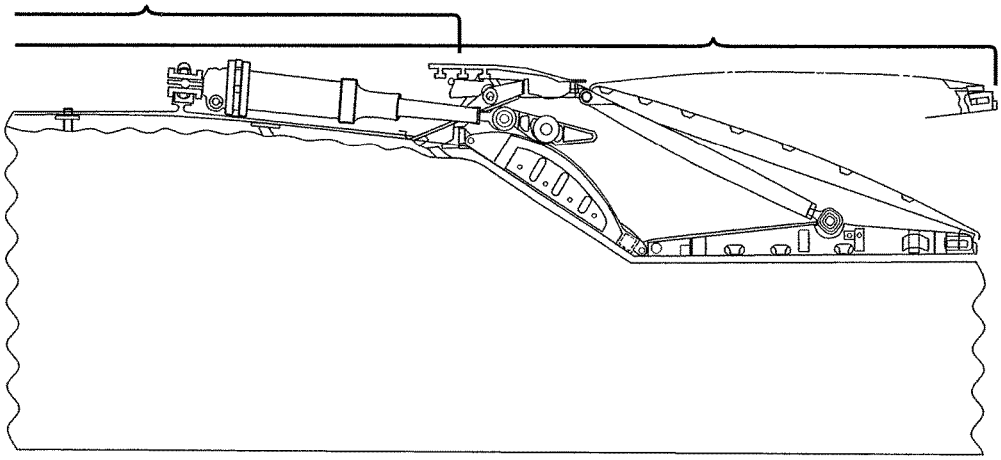
FIG. 3 PRIOR ART
FIG. 3 is a cross-sectional view of the prior art nozzle synchronized system shown in FIG. 2.
Figure 4:
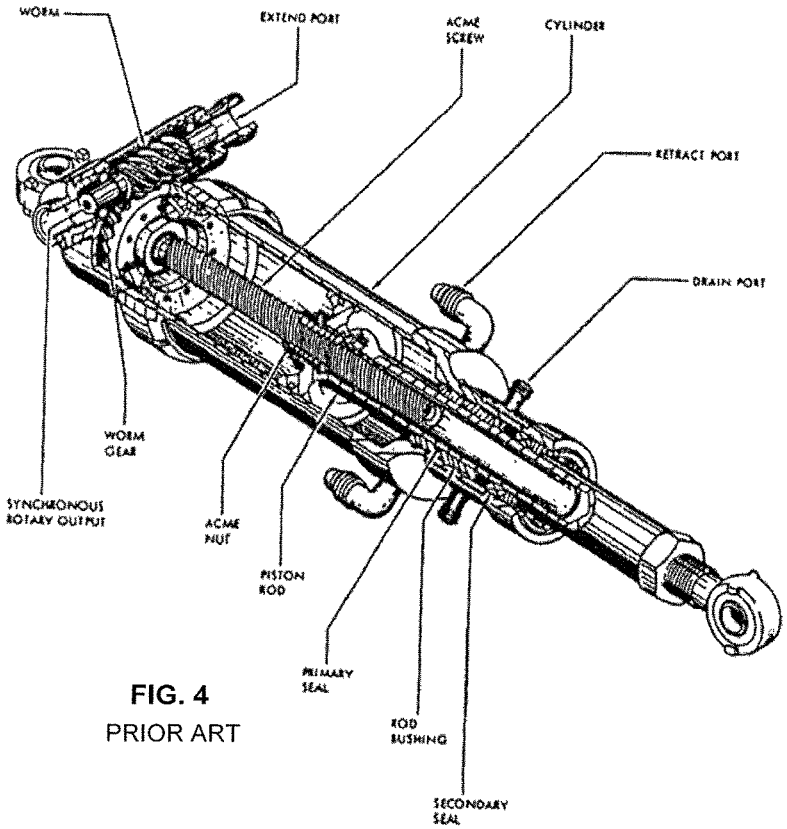
FIG. 4 PRIOR ART
FIG. 4 is a cross-sectional view of the prior art nozzle actuator shown in FIG. 3.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., crosshatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 5:
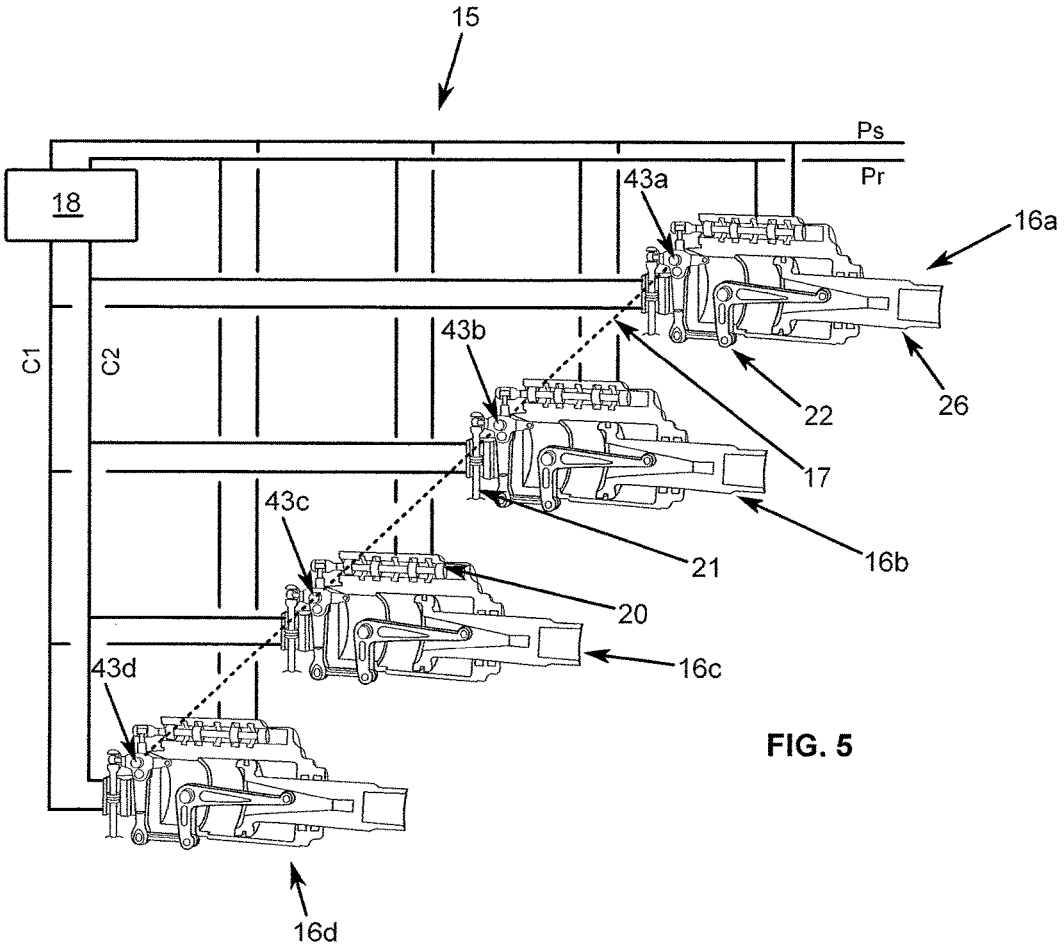
FIG. 5 is a schematic view of an embodiment of an improved nozzle actuator synchronization system.

Referring now to FIG. 5, an improved nozzle synchronization system is provided, an embodiment of which is generally indicated at 15. System 15 is shown as broadly including four actuators 16*a*, 16*b*, 16*c*, and 16*d*, a servo valve control 18, and a synchronization cable 17 mechanically connecting actuators 16*a*-16*d* at connections 43*a*, 43*b*, 43*c* and 43*d*, respectively.

As shown, servo valve 18 has operative connections Ps, Pr, C1 and C2 with actuators 16*a*-16*d* to supply pressure Ps and fluid return Pr and provide controls C1 and C2, respectively. While valve 18 in this embodiment is a four-way servo valve, it should be clearly understood that the embodiments are not limited to four-way valves, but could be readily adapted to some other form, as desired.

Figure 6:
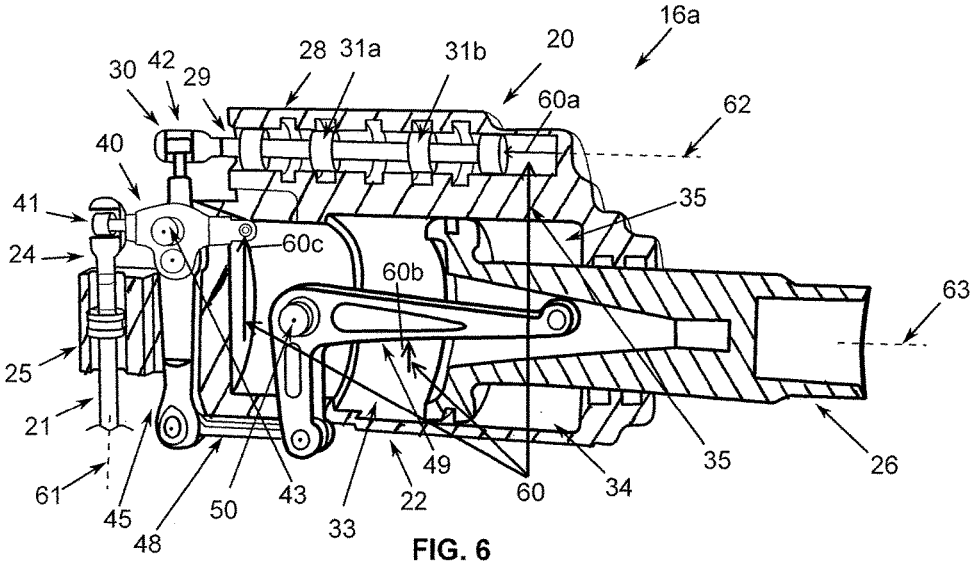
FIG. 6 is an enlarged cross-sectional view of one of the actuators shown in FIG. 5.

As shown in FIG. 6, each of actuators 16*a*-16*d* generally comprises pilot input piston 21 connected to input crank 40, hydro-mechanical servo valve 20, output piston 26, closed loop feedback linkage 22 and synchronization connection 43. As shown in FIG. 5, each of the four pilot pistons of actuators 16*a*-16*d* are flow summed to servo valve 18 and are also synchronized via connection 43 with flexible cable 17. As a result, a smaller servo valve 18 may be used that has less leakage. Supply and return pressure is individually connected to hydro-mechanical servo valve 20 of each actuator 16*a*-16*d*. As shown, cable 17 provides a mechanical connection 43*a*-43*d* between each respective input crank 40 of actuators 16*a*-16*d* and is configured such that rotational motion of each respective input crank 40 about its respective axis 44 is substantially the same and thereby synchronized. While synchronization connections 43*a*-43*d* are shown as being made directly between respective input cranks 40 of actuators 16*a*-16*d*, alternatively the mechanical connections could be made directly between respective pilot pistons 21 of actuators 16*a*-16*d*. While in this embodiment a cable provides the mechanical connector, it is contemplated that other mechanical connectors may be used to synchronize the input to valves 20 of actuators 16*a*-16*d*. For example, a universal joint may be employed as an alternative. Also, if respective axes 44 of actuators 16*a*-16*d* are aligned or coincide, a shaft or other rigid mechanical connector may be used, for example, as an alternative.

As shown in FIGS. 5-13, pilot piston 21 is adapted to be selectively and controllably shifted either upward or downward, as desired, within cylinder 25 with servo valve 18 lines C1 and C2. Pilot piston 21 includes curled or notched end 24.

Figure 7:
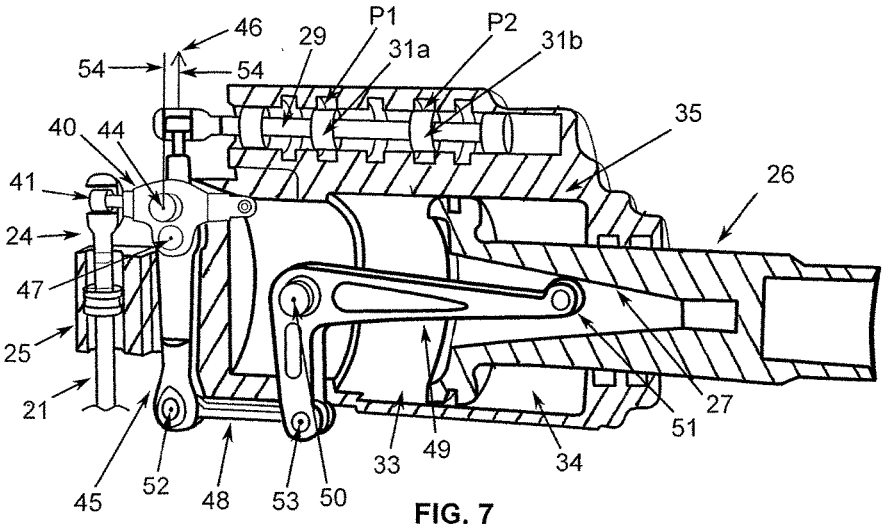
FIG. 7 is a cross-sectional view of the actuator shown in FIG. 6 at the null position.

Spool 29 of servo valve 20 has a plurality of lands and grooves along its longitudinal extent in the usual manner, and is adapted to be selectively and controllably shifted either leftwardly or rightwardly, as desired, within cylinder 28 from the null position shown in FIG. 7. In the null position, respective lands 31*a* and 31*b* on valve spool 29 cover the appropriate ports P1 and P2 communicating with the left and right chambers 33 and 34, respectively, of output piston cylinder 35 to prevent flow through valve 20. Ps and Pr ports are provided on the left and right sides, respectively, of land 31*a* of spool 29.

Closed loop feedback linkage 22 generally comprises input crank 40, input link 45, feedback link 48 and elbow link 49. As shown, input crank 40 is configured to rotate about fixed axis 44 and includes quill 41 and cable attachment 43. Quill 41 has a rounded distal end portion received in notched end 24 of pilot piston 21. Flexible cable 17 is attached at cable attachment 43 and synchronizes the low force/low friction input cranks 40 of each of actuators 16*a*-16*d*. Crank 40 is rotationally connected at pivot joint 47 to input link 45.

The top end of input link 45 includes quill 42, which has a rounded distal end portion received in notched end 30 of spool 29. The other end of input link 45 is rotationally connected at pivot joint 52 to the left end of feedback link 48. The right end of feedback link 48 is in turn rotationally connected at pivot joint 53 to the bottom left end of elbow link 49.

Elbow link 49 is configured to rotate about fixed axis 50. Output piston 26 includes an inwardly and leftwardly-facing frusto-conical inner tapered bore 27, as shown. The right upper end of elbow link 49 includes cam roller 51, which bears against and rolls along the inner tapered surface 27 of piston 26. Pivot joints 47, 52 and 53 are said to be floating pivot joints since their axis of rotation is not fixed relative to the actuator body. Axes 44 and 50 are not floating.

As shown in FIG. 6, spring force preloads 60 are provided to bias spool 29 to the left, to bias elbow link 49 to rotate in a counter-clockwise direction about fixed axis 50, and to bias input crank 40 to rotate in a counterclockwise direction about fixed axis 44. As shown in FIG. 7, in the null position, center line 46 (in this embodiment extending through axes 47 and 52) of input link 45 is offset rightwardly a distance 54 from input crank axis 44, and rotational or pivot axis 47 of input link 45 is below and to the right an eccentric distance relative to fixed axis 44 of input crank 40.

FIG. 7 shows actuator 16 in a first null position or configuration. As shown, in the null configuration of FIG. 7 hydraulic flow between hydraulic control port P1 and cylinder chamber 33 is blocked by land 31*a*. Similarly, hydraulic flow between control port P2 and cylinder chamber 34 is blocked by land 31*b*. Thus, hydraulic fluid in chambers 33 and 34 is prevented from flowing out by spool lands 31*a* and 31*b*, respectively. Thus, piston 26 is constrained from moving.

Figure 8:
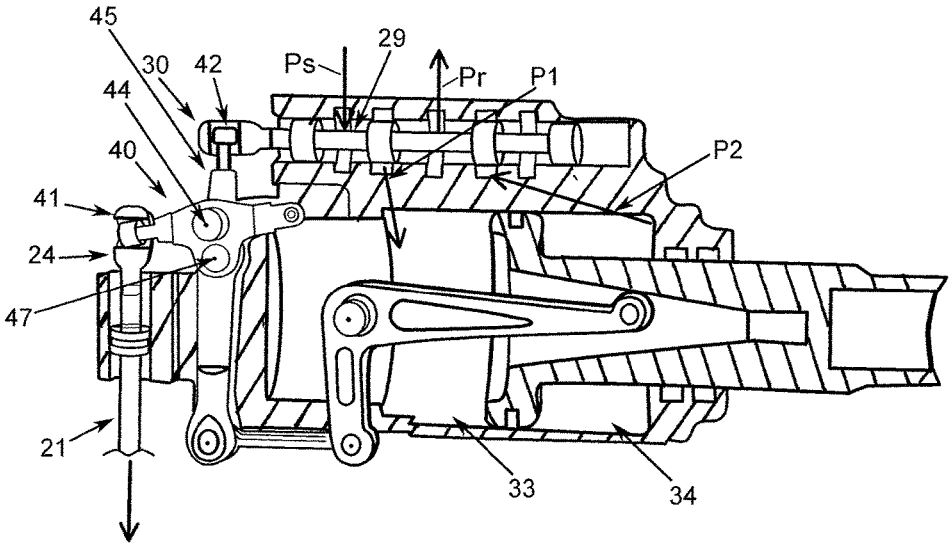
FIG. 8 is a cross-sectional view of the actuator shown in FIG. 6 upon a down command.
Figure 9:
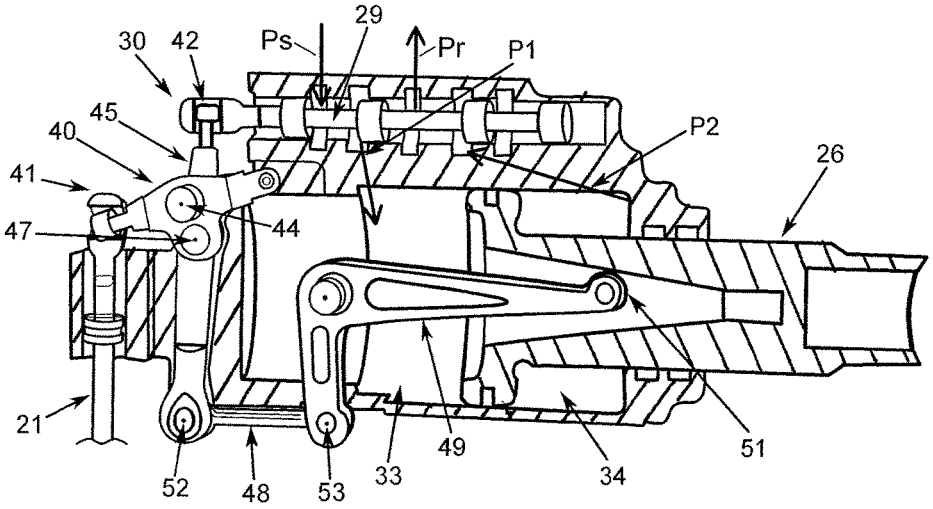
FIG. 9 is a cross-sectional view of the actuator shown in FIG. 6 as it continues to move down.
Figure 10:
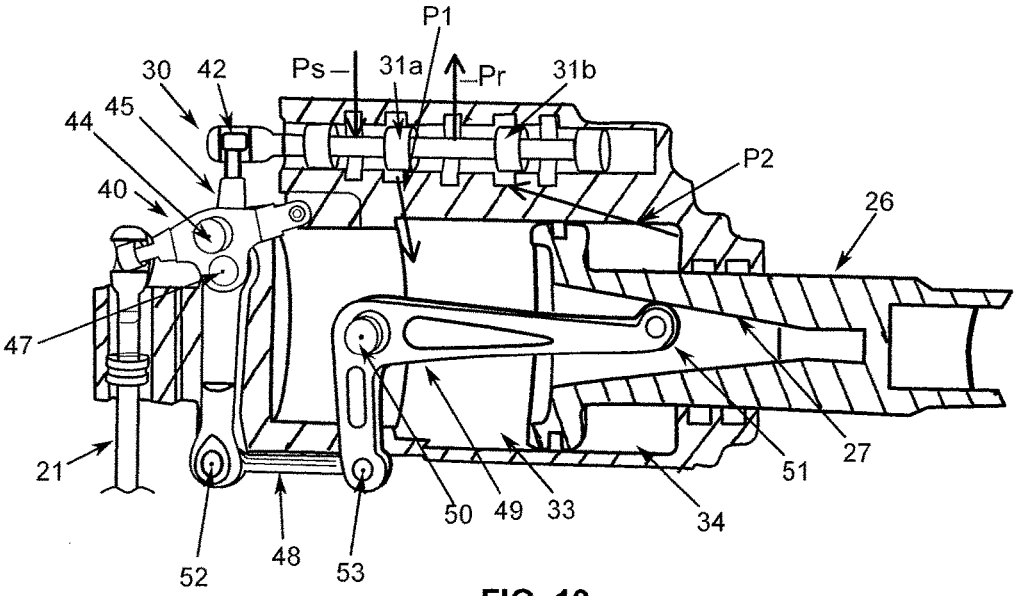
FIG. 10 is a cross-sectional view of the actuator shown in FIG. 6 with the output piston responding to the valve opening.
Figure 11:
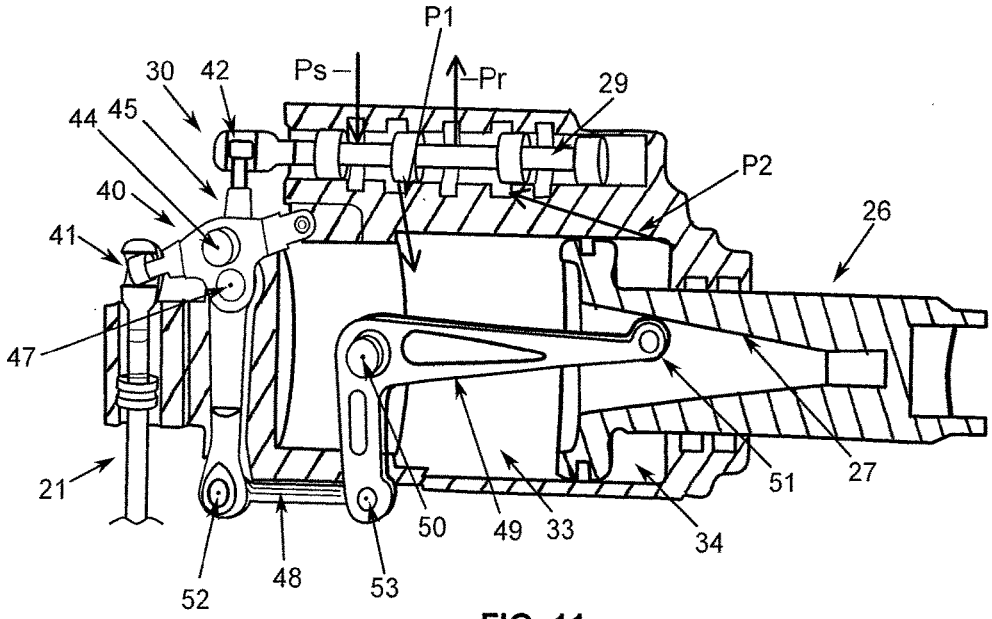
FIG. 11 is a cross-sectional view of the actuator shown in FIG. 6 with the feedback linkage providing a cancelling return.

FIG. 8 shows actuator 16 immediately upon a command from servo valve 18 to move pilot piston 21 down on axis 61. With this command, pilot piston 21 is configured and arranged to slide downward in cylinder 25. As piston 21 moves down, end 24 causes quill 41 and input crank 40 to rotate counter-clockwise about axis 44. Because at this point piston 26 is constrained from movement as described above, pivot joint 52 momentarily acts as a fixed axis. Because of this and the eccentric offset described above, counter-clockwise rotation of input crank 40 about axis 44 causes quill 42 of input link 45 to move to the right. The movement of quill 42 to the right causes notched end 30 and valve spool 29 to move to the right within cylinder 28 on axis 62. As shown in FIGS. 9-11, as valve spool 29 is moved right, spool lands 31*a* and 31*b* are no longer aligned on control ports P1 and P2, respectively, which allows fluid to flow to or from control ports Ps and Pr, respectively, and in turn to and from ports P1 and P2 and output piston chambers 33 and 34, respectively.

Figure 12:
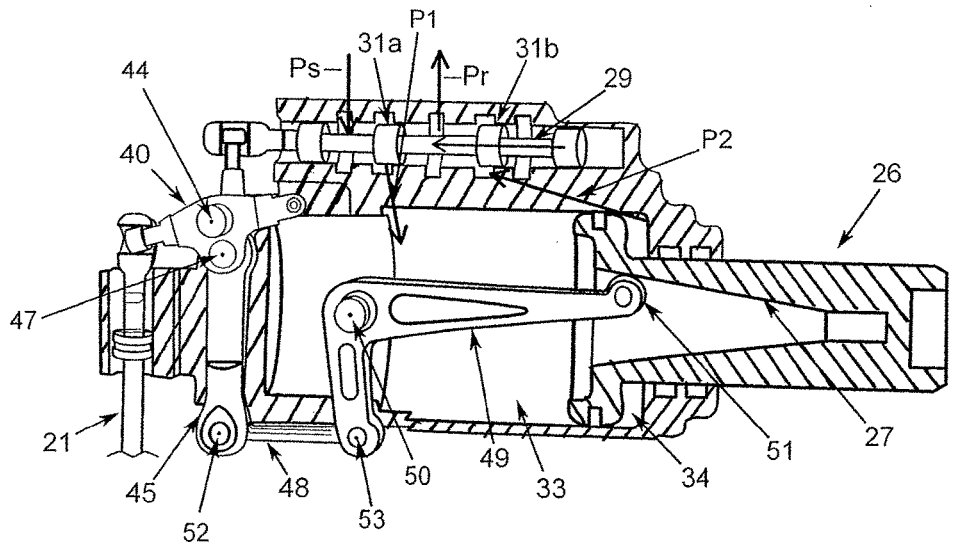
FIG. 12 is a cross-sectional view of the actuator shown in FIG. 6 as the piston moves and the hydro-mechanical valve closes.
Figure 13:
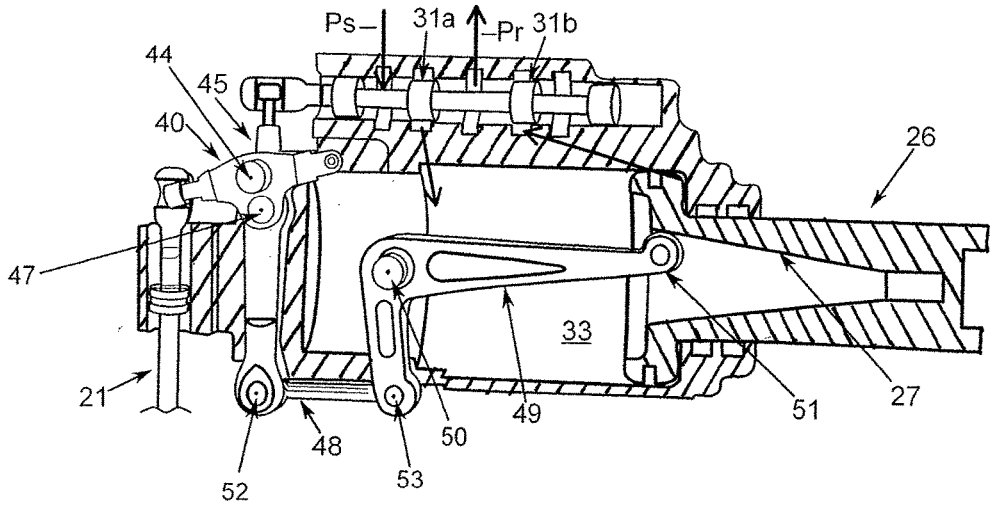
FIG. 13 is a cross-sectional view of the actuator shown in FIG. 6 with the piston no longer moving.

This controlled flow and hydraulic pressure in turn causes output piston 26 to move to the right on axis 63. As shown in FIGS. 10-11, with such movement and the spring bias or preload described above, the relative movement of piston bore 27 past roller end 51 allows elbow link 49 to rotate incrementally counter-clockwise about fixed axis 50. This causes pivot joint 53 to move counter-clockwise about axis 50 and to the right, which in turn pulls pivot joint 52 and the bottom end of input link 45 to the right. With piston 21 stationary, and input crank 40 also stationary, this causes input link 45 to rotate about axis 47 in a counterclockwise direction. At this point, counter-clockwise rotation of input link 45 about axis 47 in turn causes quill 42 of input link 45 to move to the left. The movement of quill 42 to the left causes valve 20 to close. In particular, movement of quill 42 to the left causes notched end 30 and valve spool 29 to move to the left within cylinder 28. As shown in FIGS. 12-13, as valve spool 29 is moved left, spool lands 31*a* and 31*b* realign along control ports P1 and P2, respectively, which stops fluid flow to and from control ports P1 and P2 and output piston chambers 33 and 34, respectively. Piston 26 stops moving with the closing of the ports. The output piston 26 position is proportional to the input piston 21 position.

The nozzle position is fed back to the system to control the electro-hydraulic servo valve 18 command to the input pilot piston 21 of each actuator 16. As a result, the system will operate with higher loop gain and provide more accuracy. Each actuator is closed loop position servo to input.

While the presently preferred form of the system has been shown and described, and several modifications thereof discussed, persons skilled in this art will readily appreciate that various additional changes and modifications may be made without departing from the scope of the invention, as defined and differentiated by the following claims.

The invention claimed is:

1. An actuator synchronization system comprising:

a control valve in fluid communication with a plurality of actuators, each of said actuators comprising:

an input stage element in fluid communication with said control valve and having an input member movably mounted along an input axis, and configured to be moved from a first input position to a second input position along said input axis by said control valve;

a main valve having a valve member movably mounted in a valve chamber along a main valve axis, and configured to be moved from a null position to an off-null position along said main valve axis to selectively meter fluid flow from at least one port defined between said valve member and said valve chamber;

an output stage element in fluid communication with said port of said main valve and having an output member moveably mounted along an output axis, and configured to be moved from a first output position to a second output position along said output axis by a pressure differential applied on said output member by said main valve;

said main valve and said output member configured such that said output member is at a pressure equilibrium and does not move when said valve member is in said null position;

a feedback linkage acting between said valve member and said output member;

an eccentric drive link acting between said input member and said feedback linkage and configured to rotate about a fixed drive axis;

said drive link rotationally connected to said feedback linkage at a first pivot that is off-set a distance from said fixed drive axis and configured such that selective motion of said input member between said first input position and said second input position along said input axis causes said pivot of said feedback linkage to rotate about said drive axis;

said feedback linkage and said drive link configured such that selective movement of said input member from said first position to said second position causes said drive link and said feedback linkage to move said valve member from said null position to said off-null position;

said movement of said valve member from said null position to said off-null position causes said pressure differential on said output member and said output member to thereby move from said first output position to said second output position; and said movement of said output member to said second output position causes said feedback linkage to move said valve member from said off-null position back to said null position; and a mechanical connector between each of said input stage elements and/or said drive links configured such that rotational motion of each of said respective drive links about said respective fixed drive axis is substantially the same and thereby synchronized.

2. A system as set forth in claim 1, wherein said control valve comprises a servo valve.

3. A system as set forth in claim 1, wherein said respective fixed drive axes of said actuators are aligned and said mechanical connector comprises a shaft extending between said respective input stage elements and/or said respective drive links.

4. A system as set forth in claim 1, wherein said respective fixed drive axes of said actuators are not aligned and said mechanical connector comprises a cable or universal joint extending between said respective input stage elements and/or said respective drive links.

5. A system as set forth in claim 1, wherein said input member comprises an input piston moveably mounted in an input chamber in fluid communication with said control valve.

6. A system as set forth in claim 5, wherein said input piston comprises a portion having a slot bounded by substantially-parallel walls and said drive link comprises a rounded marginal end portion engaging said slot walls.

7. A system as set forth in claim 5, wherein said output member comprises an output piston moveably mounted in an output chamber in fluid communication with said port of said main valve.

8. A system as set forth in claim 7, wherein said feedback linkage comprises a first link engaging said valve member at a first connection and a second link engaging said output piston at a second connection.

9. A system as set forth in claim 8, wherein said valve member comprises a slot bounded by substantially-parallel walls and said first link of said feedback linkage comprises a rounded marginal end portion contacting said slot walls to form said first connection.

10. A system as set forth in claim 8, wherein said output piston comprises a contoured surface and said second link of said feedback linkage comprises a rolling marginal end portion configured to contact said contoured surface of said output piston to form said second connection.

11. A system as set forth in claim 8, wherein said feedback linkage comprises a third link connected to said first link at a third connection and connected to said second link at a fourth connection.

12. A system as set forth in claim 11, wherein said first link and said third link are rotationally coupled at said third connection and said second link and said third link are rotationally coupled at said fourth connection.

13. A system as set forth in claim 12, wherein said second link is configured to rotate about a fixed feedback axis and said fourth connection is off-set a distance from said fixed feedback axis such that selective motion of said output piston between said first output position and said second output position along said output axis causes said fourth connection of said feedback linkage to rotate about said feedback axis.

14. A system as set forth in claim 13, wherein said feedback linkage is configured to move said valve member from said null position to said off-null position with selective rotation of said drive link about said drive axis.

15. A system as set forth in claim 13, wherein said feedback linkage is configured to move said valve member from said off-null position back to said null position with selective rotation about said feedback axis.

16. A system as set forth in claim 1, wherein:

said main valve comprises a second port;

said output member comprises an output piston moveably mounted in an output chamber in fluid communication with said port of said main valve;

said output chamber comprises a first chamber and a second chamber;

said first port is flow connected to said first chamber and said second port is flow connected to said second chamber; and said output piston is adapted to be moved from said first position to said second position along said output axis as a function of a hydraulic pressure differential between said first chamber and said second chamber.

17. The system as set forth in claim 1, wherein each of said respective actuators further comprises a bias mechanism configured to bias one or more of said valve member, said drive link and said feedback linkage.

18. The system as set forth in claim 17, wherein said second link is configured to rotate about a fixed feedback axis and said bias mechanism comprises a first bias element configured to bias said valve member along said main valve axis, a second bias element configured to bias said output member about said feedback axis and a third bias element configured to bias said drive link about said drive axis.

19. The system as set forth in claim 18, wherein said first bias element comprises a compression spring and said third bias element comprises a torsional spring.

20. A system as set forth in claim 1, wherein said valve member comprises a valve spool.

* * * * *